US007946143B2

(12) United States Patent
Rafferty et al.

(10) Patent No.: US 7,946,143 B2
(45) Date of Patent: May 24, 2011

(54) UNIVERSAL BOX LOCK

(75) Inventors: Robert E. Rafferty, Rutland, MA (US); John C. Mahaney, Spencer, MA (US); Anthony J. Agbay, Spencer, MA (US)

(73) Assignee: Inner-Tite Corp., Holden, MA (US)

( * ) Notice: Subject to any disclaimer, the term of this patent is extended or adjusted under 35 U.S.C. 154(b) by 659 days.

(21) Appl. No.: 11/959,682

(22) Filed: Dec. 19, 2007

(65) Prior Publication Data

US 2009/0158788 A1 Jun. 25, 2009

(51) Int. Cl.
*B65D 55/14* (2006.01)

(52) U.S. Cl. ..... 70/164; 70/2; 70/63; 70/159; 292/281; 292/340

(58) Field of Classification Search ..... 70/2, 6–14, 70/34, 54–56, 63, 158–173, 232, 370–371, 70/386, 451, 466; 292/281, 282, 286, 340, 292/DIG. 53; 248/551–553
See application file for complete search history.

(56) References Cited

U.S. PATENT DOCUMENTS

| | | | | |
|---|---|---|---|---|
| 1,343,851 | A | 6/1920 | Roe | |
| 3,198,876 | A * | 8/1965 | Sloop | 361/664 |
| 3,361,283 | A * | 1/1968 | Nicholson | 220/3.8 |
| 4,031,722 | A | 6/1977 | Michelman et al. | |
| 4,080,811 | A | 3/1978 | Nielsen, Jr. | |
| 4,096,718 | A * | 6/1978 | Michelman et al. | 70/63 |
| 4,107,959 | A | 8/1978 | Skarzynski et al. | |
| 4,120,182 | A | 10/1978 | Michelman et al. | |
| 4,144,729 | A | 3/1979 | Nielsen, Jr. | |
| 4,152,910 | A | 5/1979 | Swisher | |
| 4,254,647 | A | 3/1981 | Finck, Jr. | |
| 4,414,829 | A | 11/1983 | Nielsen, Jr. et al. | |
| 4,475,365 | A | 10/1984 | Swisher | |
| 4,551,999 | A | 11/1985 | Guiler | |
| 5,007,258 | A | 4/1991 | Mahaney | |
| 5,315,849 | A | 5/1994 | Georgopoulos | |
| 5,870,911 | A | 2/1999 | DeWalch | |
| 6,684,670 | B1 | 2/2004 | Agbay et al. | |
| 6,742,365 | B1 | 6/2004 | Sullivan et al. | |
| 6,763,691 | B1 | 7/2004 | Rafferty | |
| 6,931,893 | B2 * | 8/2005 | Agbay | 70/2 |
| 6,976,373 | B1 | 12/2005 | Sullivan et al. | |
| 7,021,090 | B1 | 4/2006 | Nolle et al. | |
| 7,377,134 | B1 * | 5/2008 | Sullivan et al. | 70/2 |
| 7,775,071 | B2 * | 8/2010 | Agbay | 70/34 |
| 2005/0224250 | A1 * | 10/2005 | Stachowiak, Jr. | 174/66 |
| 2006/0254327 | A1 * | 11/2006 | Stachowiak, Jr. | 70/164 |
| 2006/0277955 | A1 * | 12/2006 | Debrody et al. | 70/164 |
| 2007/0205012 | A1 * | 9/2007 | Stachowiak, Jr. | 174/58 |

(Continued)

*Primary Examiner* — Suzanne D Barrett
(74) *Attorney, Agent, or Firm* — McCormick, Paulding & Huber LLP

(57) ABSTRACT

A universal box lock for securing a meter box including a first clamping means, a second clamping means operatively connected to the first clamping means. The second clamping means being movable relative to the first clamping means. The box lock also includes a biasing means for urging the second clamping means toward the first clamping means to secure the box lock to a wall of a meter box placed between the first and second clamping means. Moreover, the box lock includes a body portion, which selectively engages and secures the first and second clamping means to a meter box wall. The first clamping means includes an aperture configured to allow a portion of the second clamping means to extend through the aperture facilitating the attachment of the inventive box lock to a side wall or a bottom wall of a meter box.

14 Claims, 11 Drawing Sheets

U.S. PATENT DOCUMENTS

2009/0084144 A1* 4/2009 Stachowiak, Jr. ..... 70/162
2009/0268381 A1* 10/2009 Stachowiak, Jr. ..... 361/672
2010/0043507 A1* 2/2010 Dreisbach et al. ..... 70/164
2010/0044099 A1* 2/2010 Stachowiak, Jr. ..... 174/520

* cited by examiner

UNIVERSAL BOX LOCK

FIELD OF THE INVENTION

The present invention relates generally to a universal box lock, and more particularly to a universal lock that may be securely mounted to both a side and a bottom surface of a ringless meter box or similar enclosure.

BACKGROUND OF THE INVENTION

Utility boxes, such as electric meter boxes, are typically secured to prevent unauthorized access to the meter. Some boxes feature a ring, which is placed directly around the meter and locked. Other utility boxes, referred to as "ringless" boxes, do not include a lockable meter ring. Ringless boxes include a cover which is secured over the meter by placing a lock on either a side wall or a bottom wall of the box. The location of the lock is determined largely by the amount of space available. In certain applications, such as multi-unit dwellings, meter boxes abut one-another making a side installation difficult if not impossible. In other applications, a bottom installation may be logistically difficult.

Despite the above, known ringless box locks are location specific. That is, separate side and bottom locks are required for the side and bottom walls of a meter box, respectively. An example of such a lock is described in U.S. Pat. No. 6,763,691, which is incorporated by reference in its entirety herein. As will be appreciated, known locks require a utility worker to carry both side and bottom locks in the field. Moreover, utility companies must purchase and stock both side and bottom locks.

Additionally, known ring-style locks include both a lock and an integral meter seal which provides an additional level of security. The meter seal, generally a plastic and wire tab, must be broken to remove the ring-style lock. As such, the meter seal provides a utility worker with a convenient visual indicator of whether a ring-style lock has been removed. Known ringless locks, however, do not incorporate an integral meter seal in the form of a tab. Ringless locks typically employ plastic or metal ferrules, which do not offer the same level of security as a tab.

Finally, it is desirable to have a ringless box lock in which the lock is preloaded. In many cases, locks are supplied as separate components, which must be assembled on site. This complicates installation and can lead to locks being misplaced or lost. Moreover, a key must be employed to assemble such locks with their associated lock components. This requires widespread distribution of keys to utility workers, which in turn increases the danger that keys will be lost or stolen, thereby seriously compromising overall system security.

With the forgoing problems and concerns in mind, it is the general object of the present invention to provide a preloadable universal box lock for ringless meter boxes that may be mounted on both a side and a bottom wall of a box and can accommodate an integral meter seal tab.

SUMMARY OF THE INVENTION

It is an object of the present invention to provide a universal box lock.

It is another object of the present invention to provide a universal box lock for a ringless meter box.

It is another object of the present invention to provide a universal box lock that may be secured to both a side wall and a bottom wall of a ringless meter box.

It is another object of the present invention to provide a universal ringless box lock that provides a convenient means of determining whether the lock has been removed.

It is another object of the present invention to provide a universal ringless box lock that accepts a sealing tab to provide a convenient means of determining whether the lock has been removed.

It is another object of the present invention to provide a universal ringless box lock in which the lock is preloaded thereby eliminating the need for a key to install the lock.

This and other objectives of the present invention, and their preferred embodiments, shall become clear by consideration of the specification, claims and drawings taken as a whole.

DETAILED DESCRIPTION OF THE PREFERRED EMBODIMENT

Figure 1:
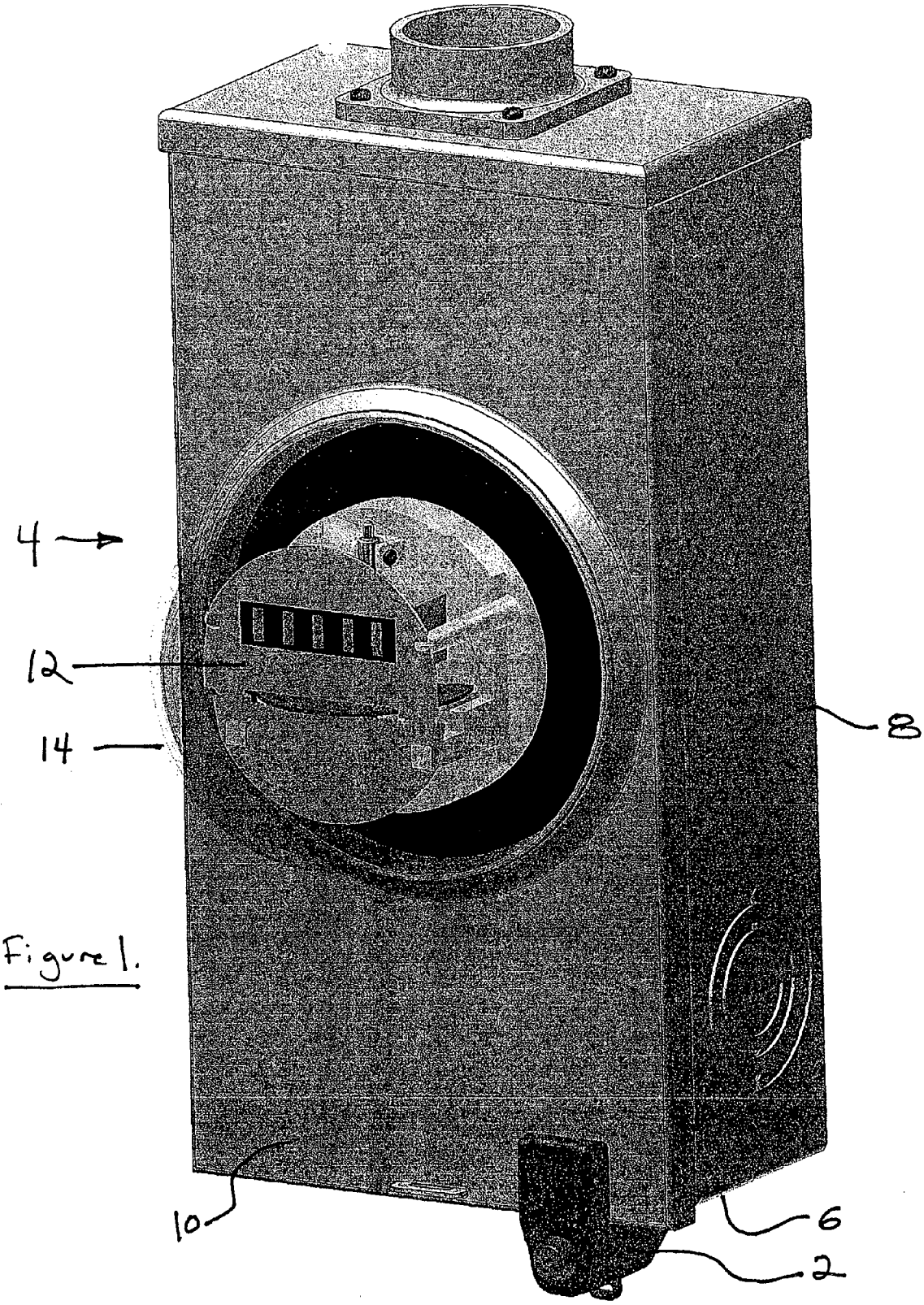
FIG. 1 is a perspective view of a universal box lock assembly according to an embodiment of the present invention secured to a bottom wall of a ringless meter box.
Figure 2:
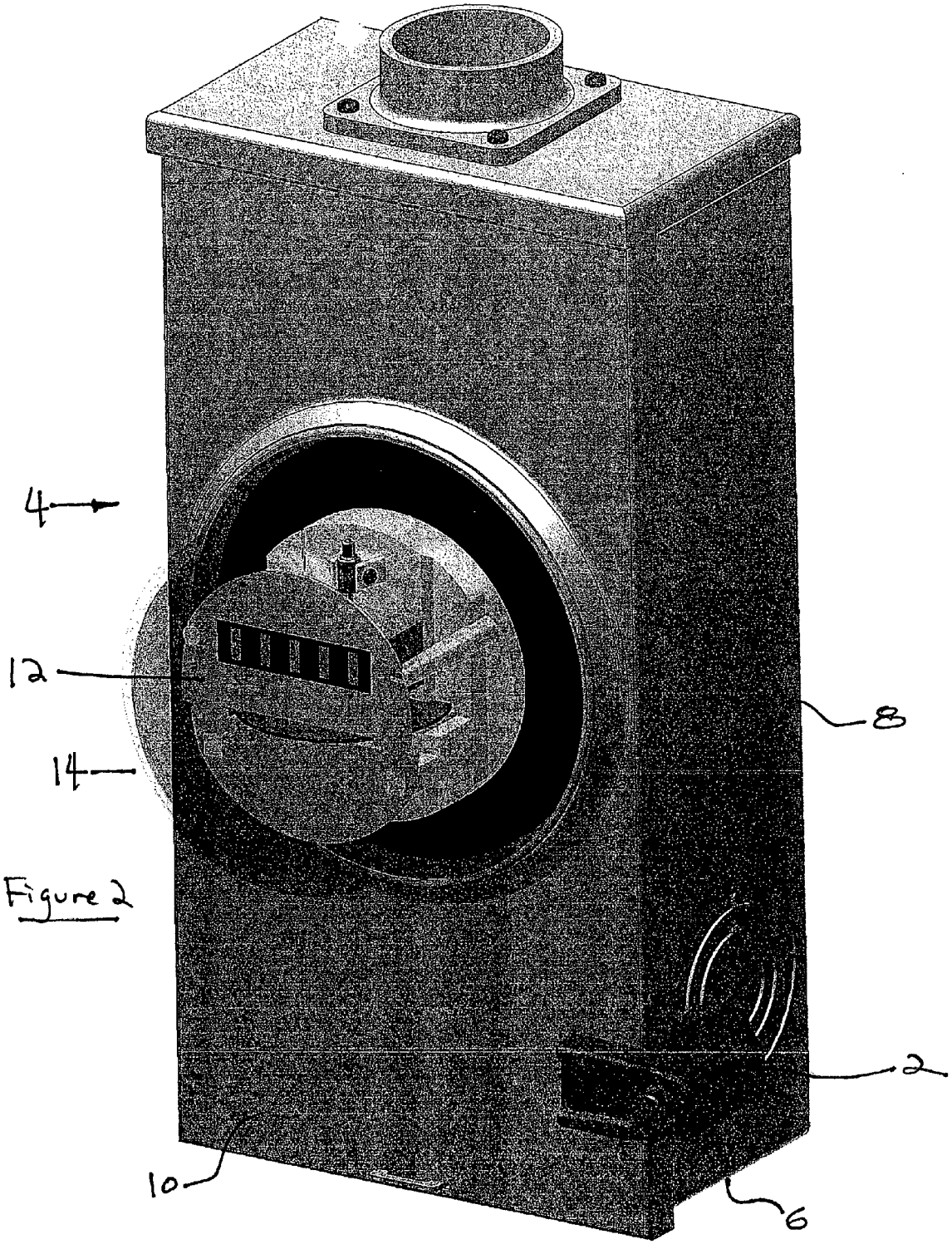
FIG. 2 is a perspective view of the universal box lock of FIG. 1 secured to a side wall of a ringless meter box.

FIGS. 1 and 2 are perspective views of a universal lock assembly 2 according to an embodiment of the present invention. The lock assembly 2 is attached to a conventional ringless meter box 4 that includes a bottom wall 6, side walls 8, and a removable cover 10. The meter box 4 encloses a meter 12, e.g., an electric meter, having a dome 14 that extends through an opening in the cover 10 of the box 4. The lock assembly 2 serves to fix the cover 10 in a closed position to prevent access to the interior of the box (not shown). As depicted in FIG. 1, the lock assembly 2 may be secured to a bottom wall 6 of the box 4. The lock assembly 2 may also be secured to a side wall 8 of the box 4 as illustrated in FIG. 2.

As will be appreciated, the ability to secure the universal lock assembly to both a side wall and the bottom wall of a ringless meter box is an important aspect of the present invention. Known ringless box locks are location specific, i.e., there are separate side and bottom locks for side and bottom walls of a meter box. As such, known locks require a utility worker to carry both side and bottom locks in the field. Moreover, utility companies must purchase and stock both side and bottom locks. The present lock assembly allows workers and utility companies to carry and stock one universal ringless lock.

Figure 3:
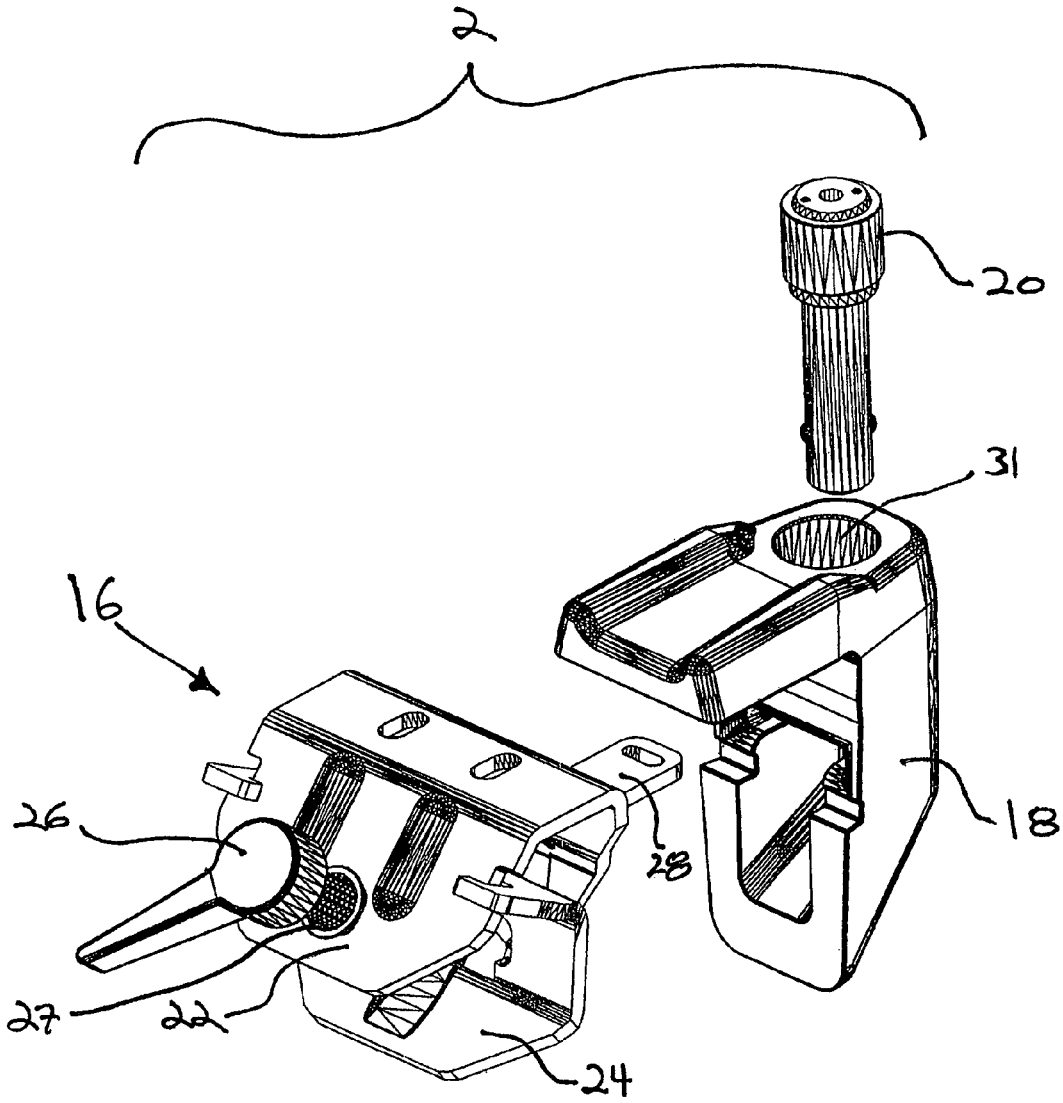
FIG. 3 is an enlarged exploded perspective view of the universal box lock assembly of FIG. 1.
Figure 4:
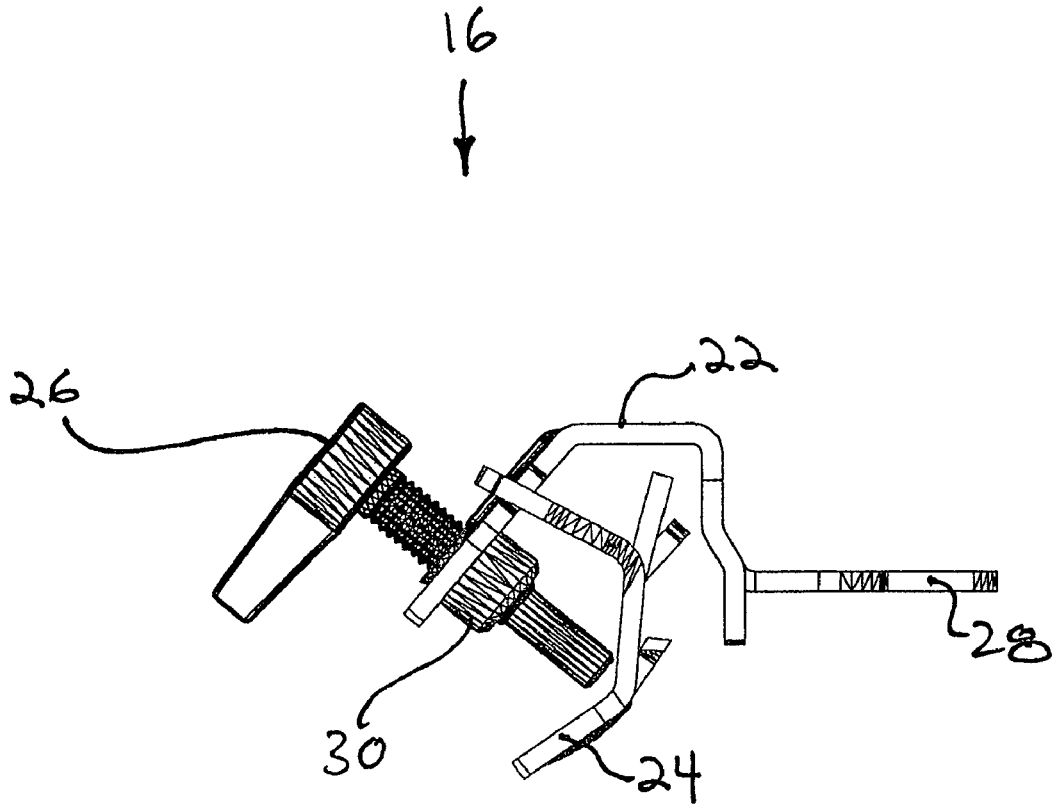
FIG. 4 is an enlarged side view of the universal box lock clamp assembly of FIG. 1.

Turning now to FIGS. 3 and 4, the lock assembly 2 includes a clamping mechanism 16, a lock body 18, and a barrel lock 20. The clamping mechanism 16 includes a first clamping means or clamp bracket 22, a second clamping means or hinge plate 24 operatively connected to the clamp bracket 22, and a biasing means such as a thumb screw 26. The thumb screw 26 extends through an opening 27 in the clamp bracket 22 and into a threaded bushing 30. Additionally, the clamp bracket 22 features a tab 28 which includes an opening 29 (FIG. 5B) that accepts a meter seal and a tab aperture 32 which is sized to accommodate the barrel lock 20. The lock body 18 includes a vertical bore 31 that is also sized to accept the barrel lock 20.

In use, the clamping mechanism 16 is secured to either a side wall or a bottom wall of a meter box. A cover is then placed on the box and the lock body 18 is placed over the clamping mechanism's tab 28, which is located on the exterior the meter box. When the bore 31 of the lock body 18 is aligned with the tab aperture 32, (FIG. 5B), the barrel lock 20 is inserted through both the bore 31 and tab aperture 32 and locked. As such, the lock assembly 2 secures a box cover in a closed position to prevent access to the interior of the box. As stated above, the present lock assembly 2 may be placed on either a side or bottom wall of a box to prevent access to a box interior. The structural features that impart this functionality are discussed in greater detail below.

Referring now to FIGS. 5B and 6A-6D, the hinge plate 24 is pivotally attached to the clamp bracket 22 through two substantially C-shaped leg portions 36, which engage notches 34 on opposite sides of the bracket 22. The bracket 22 also includes two openings 38 that allow the passage of a series of protrusions or teeth 40 so that the lock assembly 2 may be mounted on a bottom wall of a meter box. As depicted, the teeth 40 are located on the hinge plate 24 and are bent or angled outward, away from the plate 24. The teeth 40, 42 are also cut such that they are relatively pointed and sharp to bite or dig into a wall of a meter box, though as will be appreciated, the teeth need not be pointed or sharp for the lock to function.

Figure 6A:
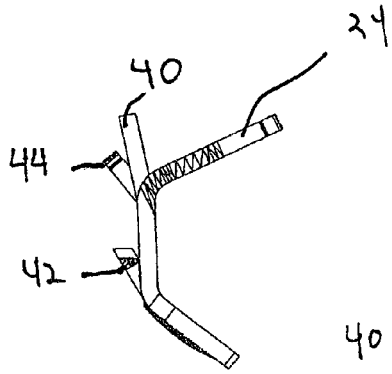
FIG. 6A is an enlarged side view of a hinge plate of the universal box lock of FIG. 1.
Figure 6B:
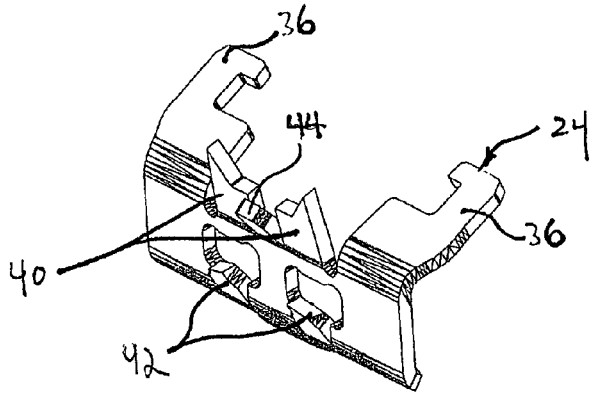
FIG. 6B is an enlarged perspective view of the hinge plate of FIG. 6A.
Figure 6C:
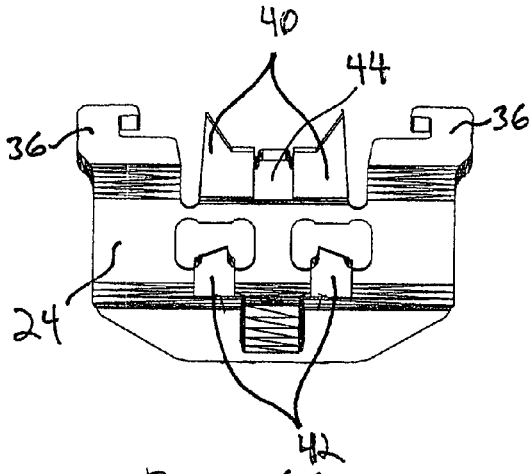
FIG. 6C is a front view of the hinge plate of FIG. 6A.
Figure 6D:
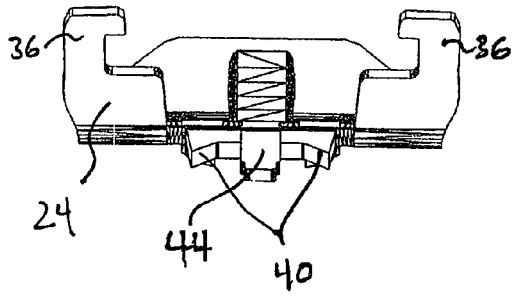
FIG. 6D is a top view of the hinge plate of FIG. 6A.

More specifically, the hinge plate 24 includes a first set of teeth 40 and a second set of teeth 42. The first set of teeth 40 are angled and engage a peripheral lip of a bottom wall of a meter box facilitating a bottom installation. The second set of teeth 42 are both angled and have chisel-shaped tips. The second set of teeth 42 engage a peripheral flange of a side wall of a meter box allowing the assembly 2 to be installed on a side of a box. As shown in FIG. 6C, the first set of teeth 40 are cut at an angle that is substantially opposite from the angle of the second set of teeth 42. As will be appreciated, other tooth shapes, angles and/or geometries are possible as long as the teeth provide sufficient bite to both prevent removal and deform a box wall to provide a visual indicator of tampering.

The teeth 40, 42 are an important aspect of the present invention in that they prevent the lock assembly 2 from being removed from a box wall by engaging and/or biting into the wall when the lock assembly 2 is pulled or otherwise forced away from the wall. Moreover, as stated, the configuration of first and second sets of teeth 40, 42 allow the clamping mechanism 16 to be secured to a bottom wall or a side wall of a meter box.

Figure 9:
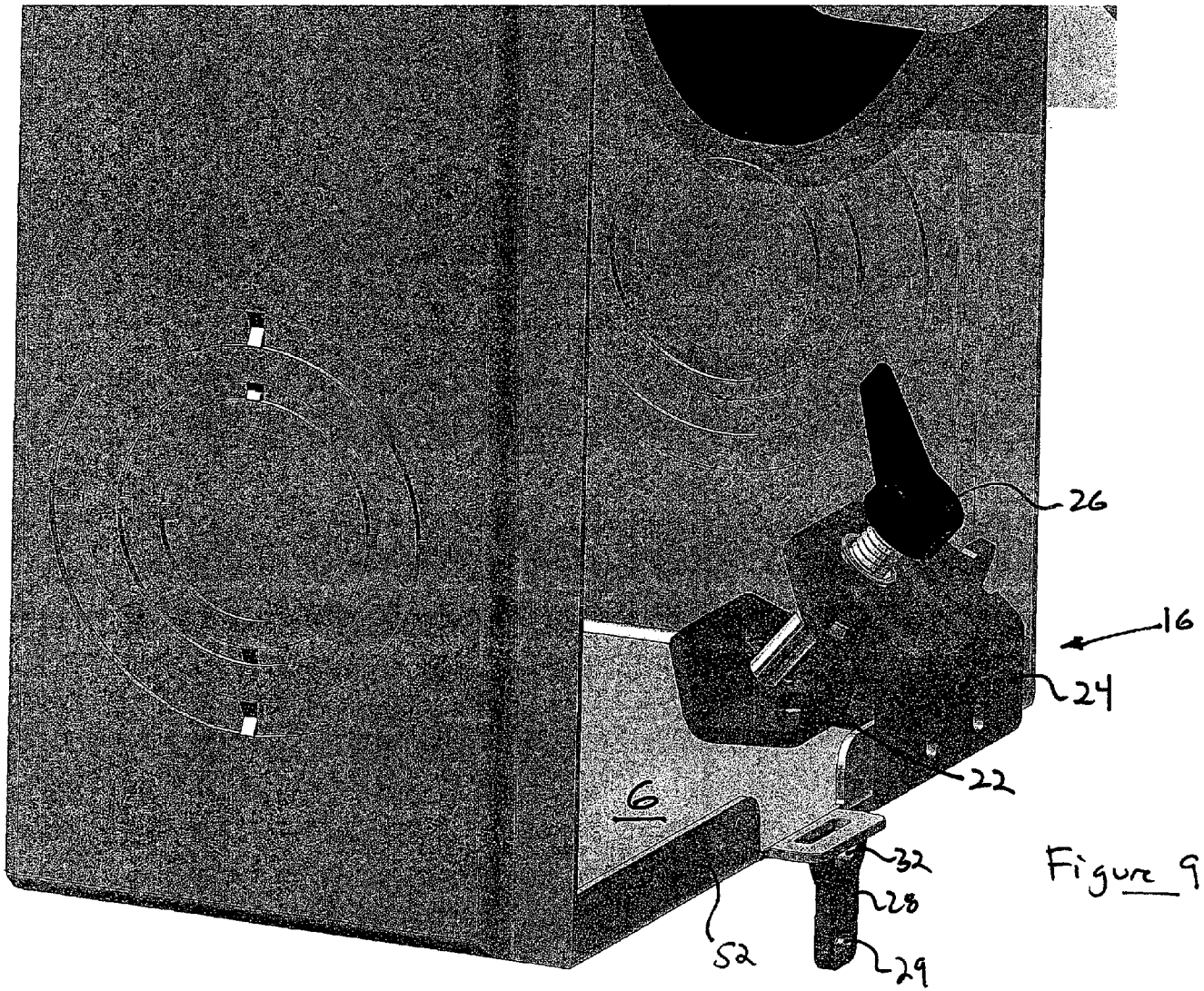
FIG. 9 is an enlarged perspective view of a clamping mechanism of the universal box lock of FIG. 1 secured to a bottom wall of a meter box.
Figure 10:
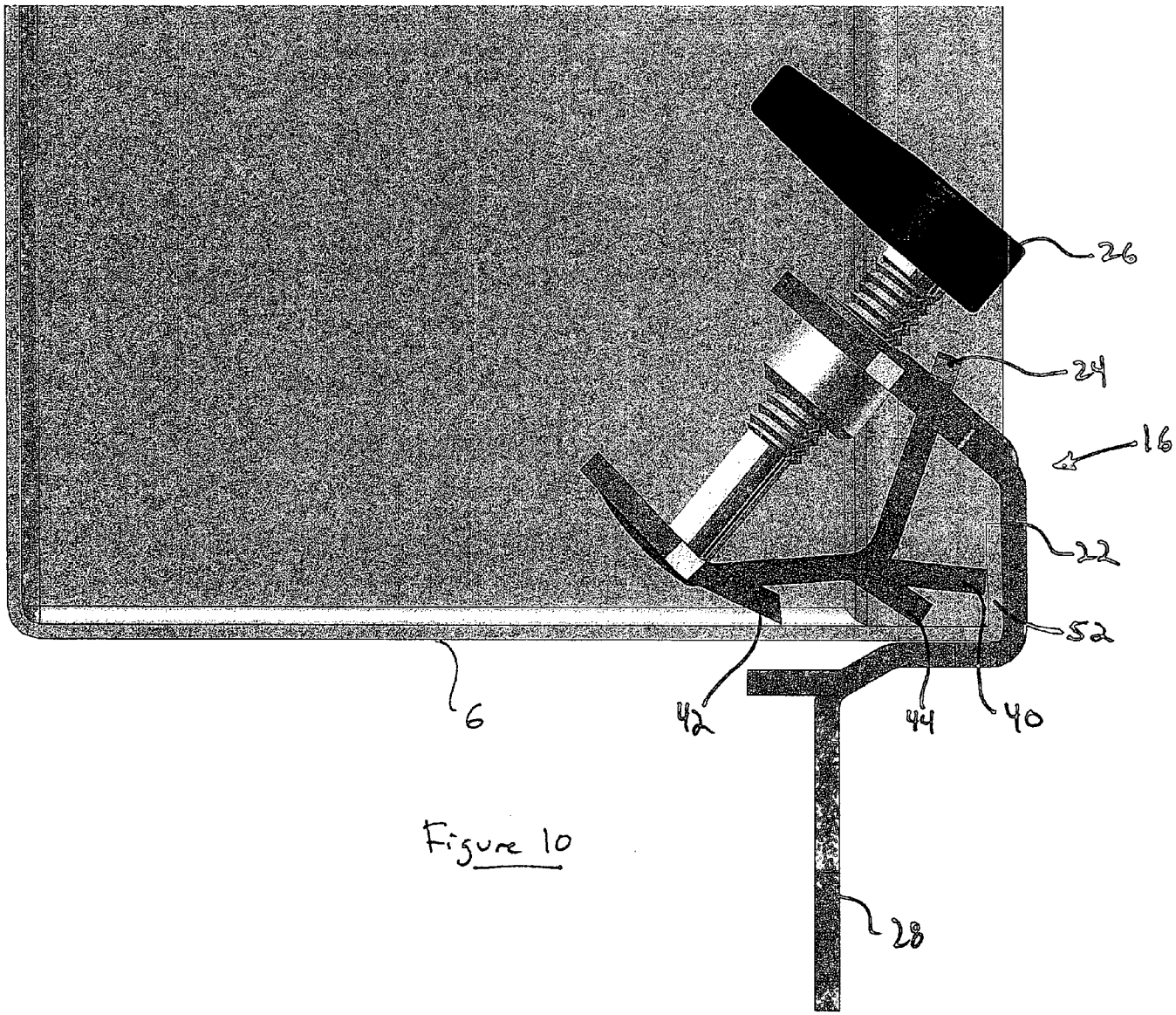
FIG. 10 is an enlarged cutaway view of the clamping mechanism of FIG. 9.

As mentioned above, the bracket 22 contains openings 38 that receive the hinge plate's teeth in certain installations. In particular, the first set of teeth 40 protrude into the openings 38 when the lock assembly is installed on a side wall of a meter box so that the second set of teeth 42 contact the side wall and press the wall against an inner portion of the bracket 22 thereby securing the clamping mechanism 16 to the meter box. With bottom installations, the first set of teeth 40 do not extend into the openings 38 as they are utilized to grip a flange 52 of the bottom wall of a meter box (FIGS. 9 and 10). As shown, the flange 52 of the bottom wall extends upward away from the bottom wall 6 and is substantially perpendicular to said wall 6.

Moreover, the hinge plate 24 also includes a leveling support 44, which contacts the bottom wall of the meter box during bottom installations. The support 44 levels the hinge plate 24 with the bottom wall which positions the first set of teeth 40 so that they may dig into or bite the flange 52 preventing removal. The support 44 also allows the thumb screw 26 to be rotated and the plate urged toward the bottom wall and clamp bracket 22 without misaligning the hinge plate 24.

The clamping mechanism 16 may be secured to a side wall or bottom wall of a meter box. This is generally accomplished by placing a meter box wall between the clamp bracket 22 and the hinge plate 24. The thumb screw 26, or other force generating means, is then rotated urging the hinge plate 24 toward the clamp bracket 22 until the first or second set of teeth 40, 42 on the hinge plate 24 contact the box wall and press the wall against the bracket 22. FIGS. 7-10 depict in detail the clamping mechanism 16 of the present invention secured to a side wall and bottom wall of a meter box.

Figure 7:
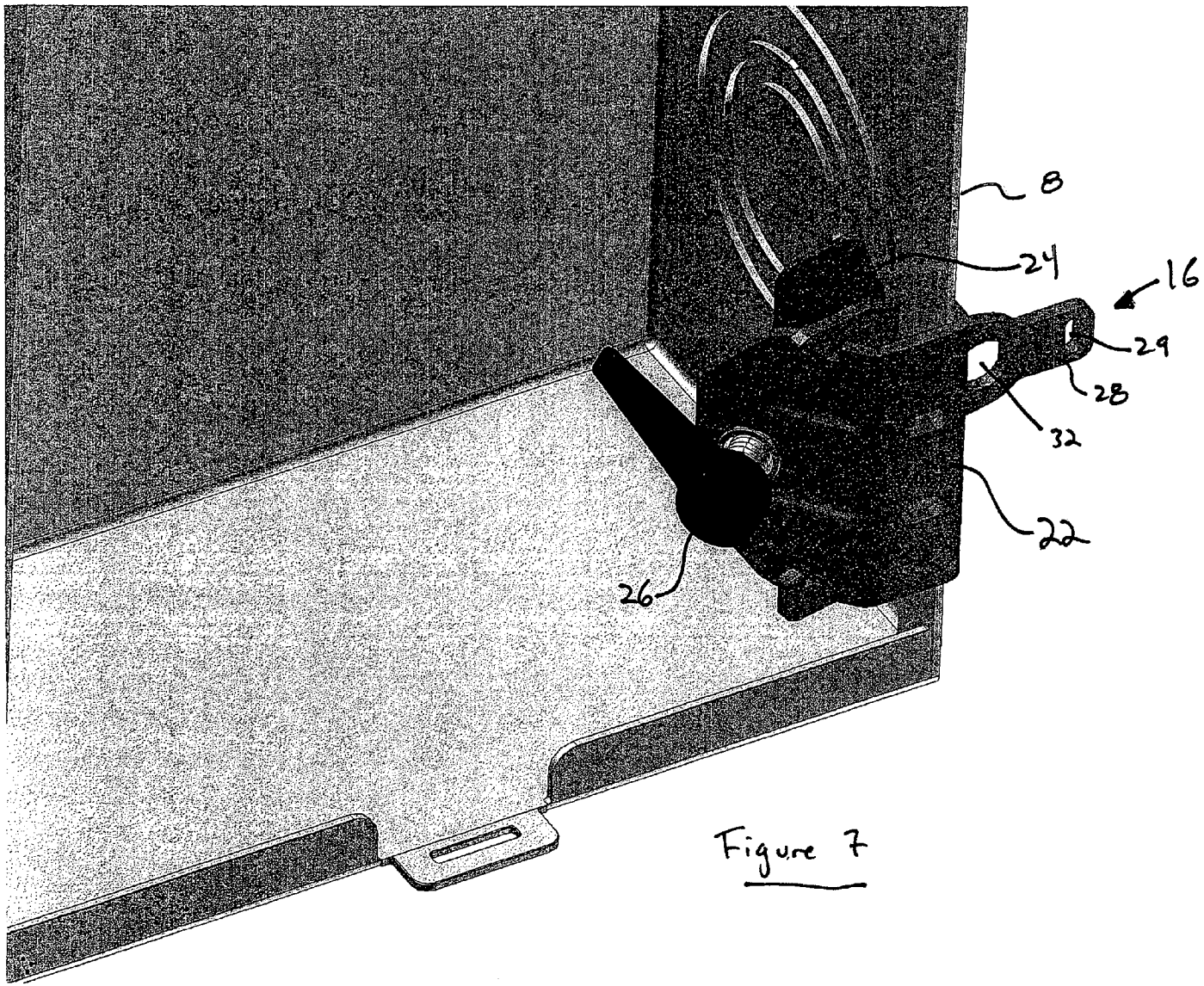
FIG. 7 is an enlarged perspective view of a clamping mechanism of the universal box lock of FIG. 1 secured to a side wall of a meter box.
Figure 8:
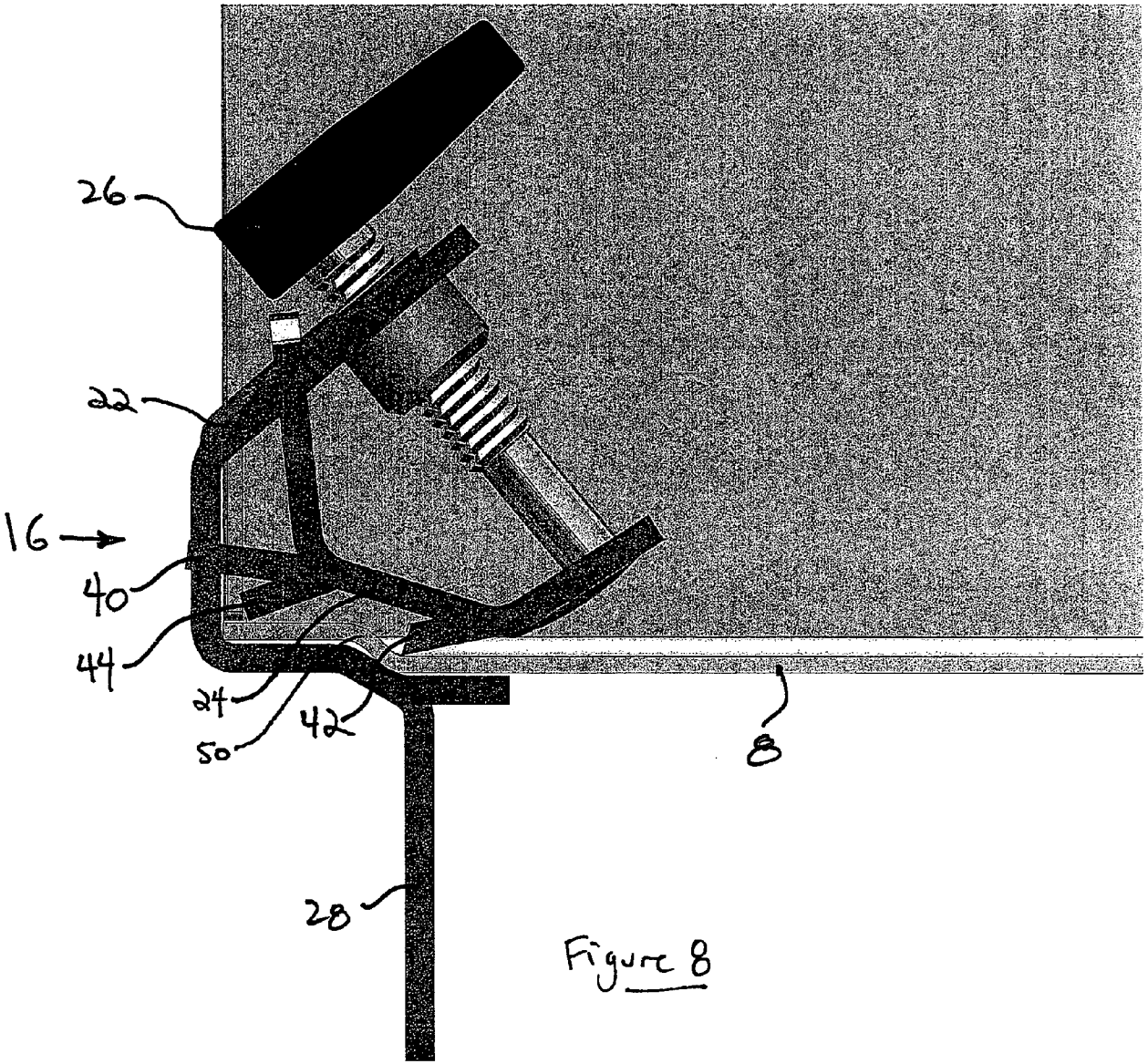
FIG. 8 is an enlarged cutaway view of the clamping mechanism of FIG. 7.

FIGS. 7 and 8 depict the clamping mechanism 16 attached to a side wall 8 of a meter box. As shown in FIG. 8, the side wall 8 has a peripheral lip 50. As will be appreciated, the peripheral lip 50 does not extend at an approximate 90-degree angle relative to the side wall 8 as does the flange 52 with the bottom wall 6. Rather, the lip 50 extends inward into the interior of the box and terminates with a portion that is substantially parallel to said side wall 8.

In use, the wall 8 and its peripheral lip 50 are placed between the bracket 22 and hinge plate 24. The thumb screw 26 is then tightened until the hinge plate 24 is firmly pressed against the wall 8. The lip 50 is in turn pressed against the bracket 22 securing the clamping mechanism 16 to the wall 8. As shown, the portion of the bracket 22 that is in contact with the lip 50 has substantially the same profile as the lip 50.

Figure 5A:
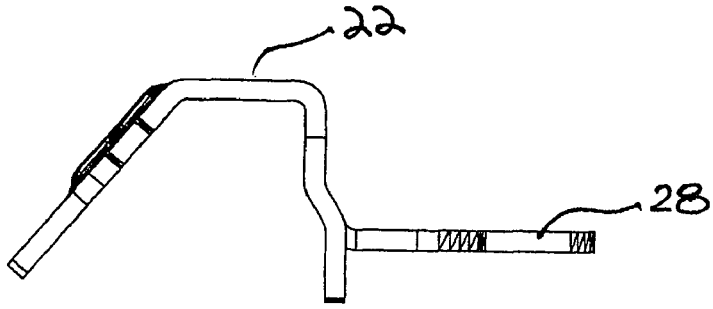
FIG. 5A is an enlarged side view of a clamp bracket of the universal box lock of FIG. 4.
Figure 5B:
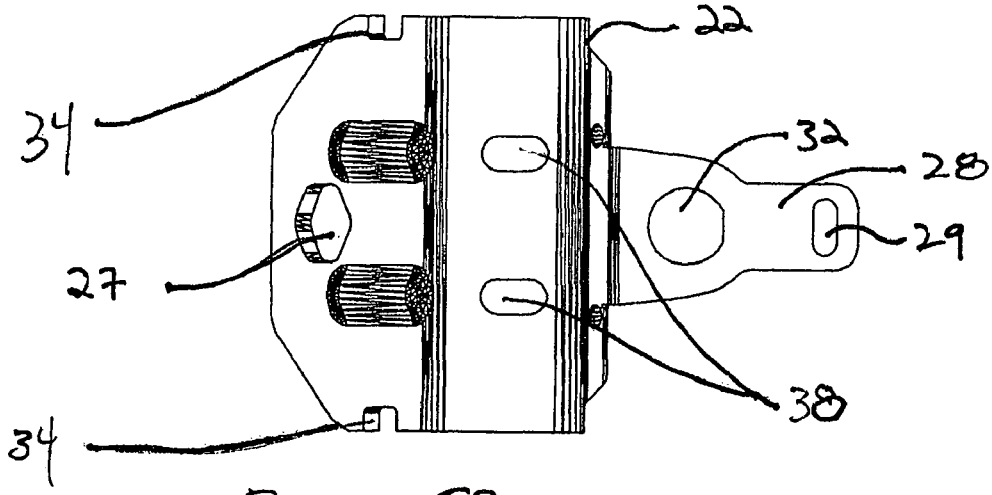
FIG. 5B is an enlarged top view of the clamp bracket of FIG. 5A.
Figure 5C:
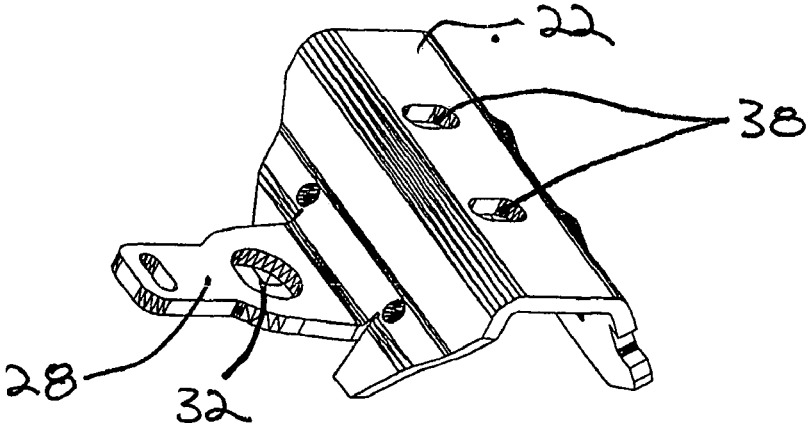
FIG. 5C is an enlarged perspective view of a clamp bracket of FIG. 5A.

Additionally, the second set of teeth 42 are in contact with the side wall 8 just before the lip 50. As will be appreciated, if the clamping mechanism 16 is forced away from the box, these teeth will bite or dig into the peripheral lip 50 preventing removal from the box. The first set of teeth 40 extend through the openings 38 in the bracket 22 and do not bite or cut into the side wall 8 when removal is attempted. The tab 28 protrudes outward away from the side wall 8 so that the lock body 18 may be attached and the barrel lock 20 inserted through the body and tab aperture 32 (FIG. 5B).

FIG. 9 shows a perspective view of the clamping mechanism 16 secured to a bottom wall 6 of a box. The bottom wall 6 has a lip 52 to which the mechanism 16 is attached. As shown in FIG. 10, the wall 6 is between the bracket 22 and the hinge plate 24. With a bottom installation, however, the first set of teeth 40 are in contact with the peripheral lip 52 and prevent the mechanism 16 from being removed. Moreover, the leveling support 44 and second set of teeth 42 also contact the bottom wall 6, but do not contact the lip and do not directly prevent removal of the mechanism. As mentioned above, the leveling support 44 serves to level the hinge plate 24 and facilitate the secure attachment of the mechanism 16 to the bottom wall 6 of a meter box. As will be appreciated, the tab 28 extends downward away from the bottom wall 6 allowing the lock body 18 and barrel lock 20 to be attached.

After the lock assembly 2 has been secured to either a side wall or bottom wall of a meter box, and a cover placed over the box, a meter seal may be attached to the assembly 2. The seal provides a visual indicator of whether someone has tampered with the assembly as any attempt to remove the lock body 18 from the clamping mechanism 16 would require removal of the seal.

Figure 11:
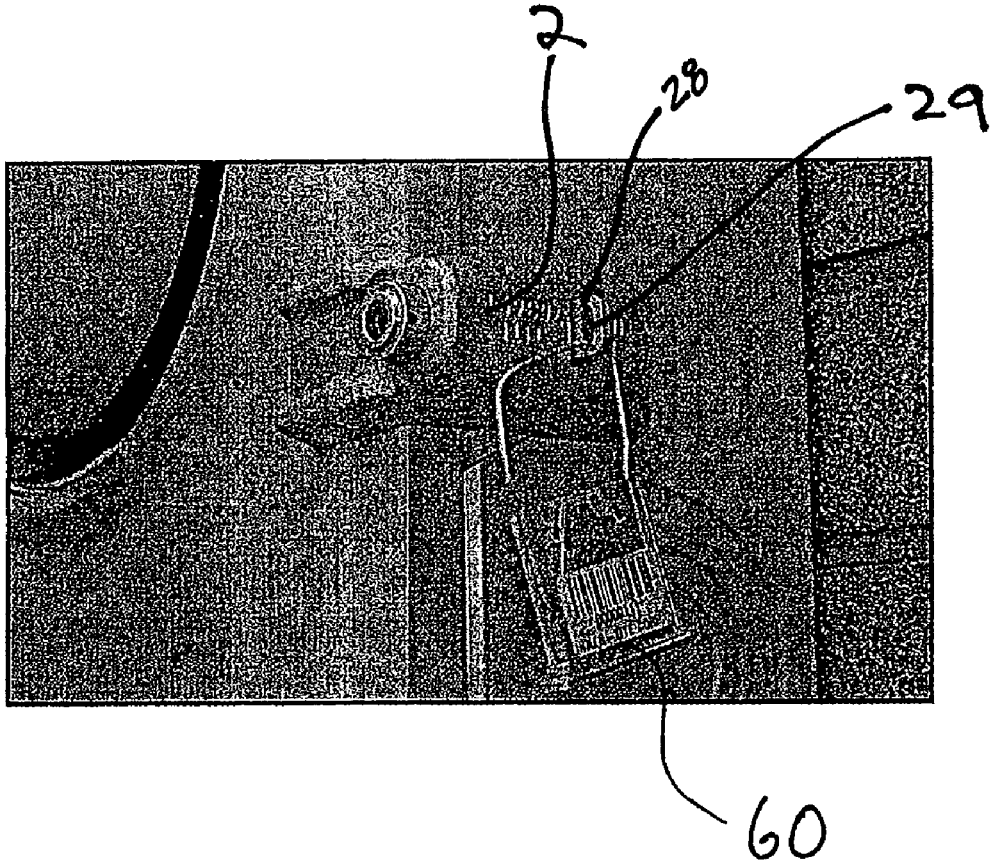
FIG. 11 is a perspective view of the universal box lock assembly of FIG. 2 including a meter seal.

Turning to FIG. 11, the meter seal 60, typically a wire loop secured with a plastic tab, is attached to the tab portion 28 of the clamp bracket 22 that extends through the lock body 18. More specifically, the wire of the seal 60 is inserted through an opening 29 in the distal end of the tab 28 and then secured. The opening 29 is shown in more detail in FIG. 5B.

The opening 29 in the tab 28 is an important aspect of the present invention as known ringless box locks do not allow for the attachment of a seal 60 that permits the use of a ferrule. The meter seal provides an additional level of security, as it must be broken to remove the lock body 18. Therefore, the meter seal provides a utility worker with a convenient visual indicator of whether the box lock has been removed.

Further, the barrel lock 20 is preferably preloaded into the lock body 18, which simplifies installations as the lock 20 does not need to be inserted into the body during installation. Moreover, utility workers do not need to carry keys to install lock assemblies and the probability of a lost or stolen key is reduced. Preloaded lock assemblies are described in greater detail in U.S. Pat. No. 6,684,670, which is incorporated by reference in its entirety herein.

Finally, the lock body 18 is preferably manufactured from hardened ductile iron. This prevents the body 18 from being sawed or drilled off thereby preventing unauthorized access to a box. In the past, lock bodies have included pins of hardened metal to prevent a top surface of the body 18 from being removed. The present use of induction hardened ductile iron renders the pins unnecessary and provides an ease of manufacture not present with known lock bodies. As will be appreciated, other metals with a hardness similar to induction hardened ductile iron may be employed.

In sum, the present invention provides a universal box lock for ringless meter boxes that may be mounted on both a side and a bottom wall of a box and can accommodate a meter seal tab. The present invention also provides a universal box lock in which the barrel lock is preloaded into the lock body for ease of installation and enhanced security.

While the invention has been described with reference to the preferred embodiments, it will be understood by those skilled in the art that various obvious changes may be made, and equivalents may be substituted for elements thereof, without departing from the essential scope of the present invention. Therefore, it is intended that the invention not be limited to the particular embodiments disclosed, but that the invention includes all embodiments falling within the scope of the appended claims.

What is claimed is:

1. A universal box lock for securing a meter box, said box lock comprising:

a first clamping means for securing said box lock to said meter box;

a second clamping means for securing said box lock to said meter box, said second clamping means operatively connected to said first clamping means, said second clamping means being movable relative to said first clamping means;

a biasing means for urging said second clamping means toward said first clamping means to secure said box lock to a wall of a meter box placed between said first and second clamping means;

a body portion which selectively engages and secures said first and second clamping means to a meter box wall; and wherein said second clamping means includes a first set of teeth for engaging a bottom wall of a meter box, and a second set of teeth for engaging a side wall of a meter box, and said first clamping means includes an aperture configured to allow said first set of teeth pass through said aperture in said first clamping means enabling said second set of teeth to contact and engage said side wall of said meter box so that said universal box lock may be secured to either a side wall or a bottom wall of a meter box.

2. The universal box lock of claim 1 wherein said second clamping means is hingedly attached to said first clamping means allowing said second clamping means to move in a substantially arcuate path relative to said first clamping means; and wherein said biasing means urges said second clamping means toward said first clamping means in said substantially arcuate path.

3. The universal box lock of claim 1 wherein said biasing means is a thumb screw located on said first clamping means.

4. The universal box lock of claim 1 in which said second clamping means includes a leveling means for facilitating the secure attachment of said second clamping means to a bottom wall of a meter box, said leveling means contacting said bottom wall of said meter box.

5. The universal box lock of claim 1 further comprising:

a barrel lock, said barrel lock being preloaded in said lock body eliminating the need for a key to activate said box lock during an installation.

6. A universal box lock for selectively securing a utility box, said box lock comprising:

a first clamping means for securing said box lock to a utility box;

a second clamping means for securing said box lock to a utility box, said second clamping means is hingedly attached to said first clamping means allowing said second clamping means to move in a substantially arcuate path relative to said first clamping means;

a biasing means for urging said second clamping means toward said first clamping means in said substantially arcuate path, said biasing means being located on said first clamping means;

a body portion which selectively engages and secures said first and second clamping means to a utility box wall;

wherein said first clamping means includes an aperture configured to allow a portion of said second clamping means to extend through said aperture facilitating the attachment of said box lock to a utility box wall that terminates with a flange portion that is substantially perpendicular to said wall or a utility box wall that terminates with a lip portion that is substantially perpendicular to said wall;

wherein said second clamping means includes a first set of teeth for engaging said flange portion of a utility box wall to prevent unauthorized removal of said box lock, and a second set of teeth for engaging said lip portion of a utility box wall; and wherein said first set of teeth pass through said aperture in said first clamping means enabling said second set of teeth to contact and engage said lip portion of said utility box wall to prevent unauthorized removal of said box lock.

7. The universal box lock of claim 6 wherein at least one of said teeth have a distal end portion which is angled to create a sharp surface which bitingly engages said flange or said lip portion of said utility box wall upon an unauthorized removal attempt of said box lock.

8. The universal box lock of claim 6 wherein said first clamping means includes a tab portion, said tab portion extending through said body portion and including an aperture that allows the attachment of a security seal, said security seal providing a visual indicator of an unauthorized removal attempt.

9. The universal box lock of claim 6 wherein said biasing means is a thumb screw located on said first clamping means.

10. The universal box lock of claim 6 in which said second clamping means includes a leveling means for facilitating the secure attachment of said second clamping means to a bottom wall of a utility box, said leveling means contacting said bottom wall of said utility box.

11. The universal box lock of claim 6 further comprising:

a barrel lock, said barrel lock being preloaded in said lock body eliminating the need for a key to activate said box lock during an installation.

12. A universal box lock for selectively securing a utility box, said box lock comprising:

a bracket;

a hinge plate operatively connected to said bracket, said hinge plate being movable in a substantially arcuate path relative to said bracket;

a biasing means for urging said hinge plate toward said bracket in said substantially arcuate path, said biasing means being located on said bracket;

a lock body which selectively engages and secures said bracket and said hinge plate to a utility box wall;

wherein said bracket includes an aperture configured to allow a portion of said hinge plate to extend through said aperture facilitating the attachment of said box lock to a utility box wall that terminates with a flange portion that is substantially perpendicular to said wall or a utility box wall that terminates with a lip portion that is substantially perpendicular to said wall;

wherein said hinge plate includes a first set of teeth for engaging said flange portion of a utility box wall to prevent unauthorized removal of said box lock, and a second set of teeth for engaging said lip portion of a utility box wall, at least one of said teeth have a distal end portion which is angled to create a sharp surface which bitingly engages said flange or said lip portion of said utility box wall upon an unauthorized removal attempt of said box lock; and wherein said first set of teeth pass through said aperture in said bracket enabling said second set of teeth to contact and engage said lip portion of said utility box wall.

13. The universal box lock of claim 12 wherein said bracket includes a tab portion, said tab portion extending through said lock body and including an aperture that allows the attachment of a security seal, said security seal providing a visual indicator of an unauthorized removal attempt.

14. The universal box lock of claim 12 wherein said lock body is manufactured from hardened iron and is preloaded with a barrel lock.

* * * * *